US008646392B2

(12) United States Patent
Graf et al.

(10) Patent No.: US 8,646,392 B2
(45) Date of Patent: Feb. 11, 2014

(54) CRASH MODULE FOR A RAIL VEHICLE

(75) Inventors: Richard Graf, Vienna (AT); Thomas Meissl, Obersdorf (AT); Andreas Rittenschober, Vienna (AT); Markus Seitzberger, Vienna (AT)

(73) Assignee: Siemens AG Osterreich, Vienna (AT)

( * ) Notice: Subject to any disclaimer, the term of this patent is extended or adjusted under 35 U.S.C. 154(b) by 0 days.

(21) Appl. No.: 13/576,542

(22) PCT Filed: Dec. 15, 2010

(86) PCT No.: PCT/EP2010/069708

§ 371 (c)(1),
(2), (4) Date: Aug. 1, 2012

(87) PCT Pub. No.: WO2011/098177

PCT Pub. Date: Aug. 18, 2011

(65) Prior Publication Data

US 2012/0325108 A1 Dec. 27, 2012

(30) Foreign Application Priority Data

Feb. 11, 2010 (AT) ..... A 201/2010

(51) Int. Cl.
*B61D 15/06* (2006.01)

(52) U.S. Cl.
USPC ..... 105/392.5; 105/396

(58) Field of Classification Search
USPC ..... 105/392.5, 394; 213/1 A, 220, 221, 222
See application file for complete search history.

(56) References Cited

U.S. PATENT DOCUMENTS

| | | | | |
|---|---|---|---|---|
| 5,660,116 | A * | 8/1997 | Dannawi et al. | 105/392.5 |
| 5,715,757 | A * | 2/1998 | Dannawi et al. | 105/392.5 |
| 6,561,105 | B2 * | 5/2003 | Godin et al. | 105/396 |
| 7,597,051 | B2 * | 10/2009 | Gough | 105/392.5 |
| 7,810,437 | B2 * | 10/2010 | Mattschull | 105/392.5 |
| 8,225,722 | B2 * | 7/2012 | Graf et al. | 105/392.5 |
| 2004/0040463 | A1 * | 3/2004 | Yamamoto et al. | 105/396 |
| 2004/0159263 | A1 * | 8/2004 | Yamamoto et al. | 105/392.5 |
| 2007/0261592 | A1 * | 11/2007 | Mochida et al. | 105/392.5 |
| 2008/0041268 | A1 * | 2/2008 | Seitzberger et al. | 105/392.5 |
| 2008/0236440 | A1 * | 10/2008 | Nakamura et al. | 105/392.5 |
| 2008/0314282 | A1 * | 12/2008 | Malfent et al. | 105/392.5 |
| 2010/0218701 | A1 * | 9/2010 | Graf et al. | 105/392.5 |
| 2011/0162555 | A1 * | 7/2011 | Hayashi | 105/392.5 |
| 2012/0325108 | A1 * | 12/2012 | Graf et al. | 105/392.5 |

FOREIGN PATENT DOCUMENTS

| | | | |
|---|---|---|---|
| DE | 10301273 | A1 | 4/2004 |
| DE | 102008007590 | A1 | 8/2009 |
| EP | 1090829 | A1 | 4/2001 |
| EP | 1927524 | A1 | 6/2008 |
| JP | 2001088698 | A | 4/2001 |
| WO | WO 2006042348 | A1 | 4/2006 |
| WO | WO 2009040309 | A1 | 4/2009 |

* cited by examiner

*Primary Examiner* — Jason C Smith

(57) ABSTRACT

A crash module for a rail vehicle includes at least one crash element, which is arranged in front of the vehicle structure. At least one transverse profiled element is provided, which is connected to the at least one crash element and which has a substantially lower compressive strength in the longitudinal direction of the rail vehicle than in the transverse direction.

13 Claims, 6 Drawing Sheets

CRASH MODULE FOR A RAIL VEHICLE

CROSS REFERENCE TO RELATED APPLICATIONS

This application is the U.S. National Stage of International Application No. PCT/EP2010/069708, filed Dec. 15, 2010 and claims the benefit thereof. The International Application claims the benefits of Austrian application No. A201/2010 AT filed Feb. 11, 2010. All of the applications are incorporated by reference herein in their entirety.

TECHNICAL FIELD

The invention relates to a crash module for a rail vehicle, in particular for a streetcar.

BACKGROUND ART

Crash zones are frequently incorporated in rail-mounted vehicles in order to improve their deformation behavior in collisions. The aim of these improvement measures is to absorb the impact energy in such a way that crush zones that are deformable in a defined manner convert this energy into deformation energy and in the process the loads to which the persons in the vehicle are exposed are minimized, as well as to ensure that the survival spaces in the vehicle are not too severely deformed in order to reduce the likelihood of injury to the vehicle occupants.

For this purpose extensive areas of the rail vehicle structure can on the one hand be designed so as to be able to absorb the deformation energy in a targeted manner or special crash modules are mounted onto the front and rear structure of the rail vehicle. The latter approach is advantageous because a repair after a collision is facilitated owing to the easy accessibility of said crash modules.

Collisions between rail vehicles take place essentially in the direction of the vehicle longitudinal axis, while a difference in level, due for example to different loading states of the vehicles involved in the collision, may under certain conditions lead to what is termed "override". In order to prevent this effect, protection in the form of an anti-override structure is provided in most cases, with plates provided with a tooth structure typically being mounted onto each vehicle. In the event of a collision said plates interlock and prevent the override.

A further problem presents itself in the case of rail vehicles for which there exists an increased risk of a collision with an obstacle other than another rail vehicle (in particular streetcars). It is necessary to make provision for a much broader range of collision scenarios, with unilaterally offset and transverse collisions of conventional crush zones or crash modules, which essentially are designed to withstand collisions in the longitudinal direction, are handled only to an unsatisfactory extent. The EN 15277 standard, for example, specifies crashworthiness requirements to be met by streetcar vehicles in the event of a collision with a vehicle of identical design at 15 km/h with a 40 mm vertical offset and a collision with a 3-tonne obstacle inclined at a 45-degree angle at a speed of 25 km/h (collision scenario: train in collision with a light commercial vehicle at a level crossing).

Conventional crash modules designed to handle longitudinal collisions are often unable to absorb said transverse loading satisfactorily, since said crash modules are in this case subject to a bending and shearing stress under which the affected crash element will buckle sideways in the absence of any precautionary measures to provide transverse support.

WO 2009/040309 may be cited by way of example. Although the crash module disclosed therein prevents the overriding of the rail vehicles, it provides no deformation conditions suitable for absorbing transverse collisions. A corresponding configuration of the known crash elements in a manner that enables them to handle both longitudinal and transverse collisions equally well would lead to extremely costly, complicated and heavy crash elements which are not suitable for use on rail vehicles.

SUMMARY OF THE INVENTION

The object underlying the invention is therefore to disclose a crash module for a rail vehicle which is also able to dissipate the impact energy in the event of transverse collisions and at the same is easy to construct without any significant weight disadvantage.

The object is achieved by means of a crash module having the features of claim 1. Advantageous embodiments are the subject matter of dependent claims.

The basic concept of the invention entails constructing a crash module for rail vehicles, said crash module comprising at least one crash element which is connected to a transverse profiled element. An essential property of said transverse profiled element is a different compressive strength in the direction of the vehicle longitudinal axis in relation to the compressive and shearing strength in the transverse direction, the compressive and shearing strength in the transverse direction being substantially greater than the compressive strength in the longitudinal direction. If a known crash element (constructed for example from aluminum or steel profiles or aluminum foam) is extended in such a way by means of a transverse profiled element to form a crash module according to the invention, then the energy-absorbing effect of the crash element remains practically unchanged for collisions in the vehicle longitudinal direction (owing to the low compressive strength of the transverse profiled element in the longitudinal direction of the vehicle, hardly any additional forces are exerted on the vehicle).

For transverse collisions (collisions with additional application of lateral force), as can occur for instance in accidents involving streetcars and motor vehicles, the advantageous effect of the present invention comes into play. Such a lateral force is absorbed by the transverse profiled element and introduced into specific points of the car body, the transverse profiled element supporting the laterally arranged crash element in such a way that the latter can dissipate the collision energy through plastic deformation. The crash element, which is essentially designed for longitudinal energy absorption, is thus released from the need to transfer the lateral forces into the car body structure and no kinking of said crash element occurs.

It is particularly advantageous for the transverse profiled element according to the invention to be constructed on the basis of a substantially plate-shaped material which, by virtue of specific modifications, has a different strength in different directions.

Examples of suitable candidates therefore are sheet metals having in many cases a trapezoidal cross-section, sheet metals having triangular reinforcements mounted thereon, or profiled elements with cutouts.

The transverse profiled elements are preferably made of metal, for example steel or aluminum, or aluminum alloys.

It is an essential advantageous characteristic of the invention that only very minor constructional changes to known crash modules are necessary and at the same time neither an installation space substantially greater in size is required nor a substantially increased weight of the crash module results.

A further essential advantage of the present invention is that thanks to the use of the crash module described here rail vehicles can be repaired very quickly, easily and economically in most cases (provided the impact energy was not too great) after transverse collisions, since the crash module absorbs the impact energy and consequently the car body structure is protected from damage. In known crash modules, in contrast, transverse collisions lead in most cases to damage to the car body structure.

In cases where impact energies are only small it is even possible to repair the crash module by replacement of individual affected components of the crash module.

It is furthermore particularly advantageous to configure the crash module from a plurality of crash elements (typically one each to the left and right of the vehicle longitudinal axis), a rear connecting plate, a front connecting plate and one or two transverse profiled elements. In such a way an easy-to-assemble and easily replaceable crash module can be built. In this case the car body is equipped with means for accommodating such a crash module (e.g. connecting plate with fixed connection points, called an "interface") and the crash element is secured thereto either detachably (for example by means of screwed connections) or permanently (e.g. by welding).

In an embodiment variant of the invention it is provided to equip a crash module with means for preventing climbing (anti-climber).

In a further preferred embodiment variant of the invention it is provided to design the crash module as a multi-stage structure, the first stage being implemented with reversible buffer elements which can absorb small impact energies without a plastic deformation (either of the buffer elements or of the crash elements) occurring in the process.

BRIEF DESCRIPTION OF THE DRAWINGS

Exemplary embodiments are illustrated in the drawings, in which.

EMBODIMENT OF THE INVENTION

Figure 1:
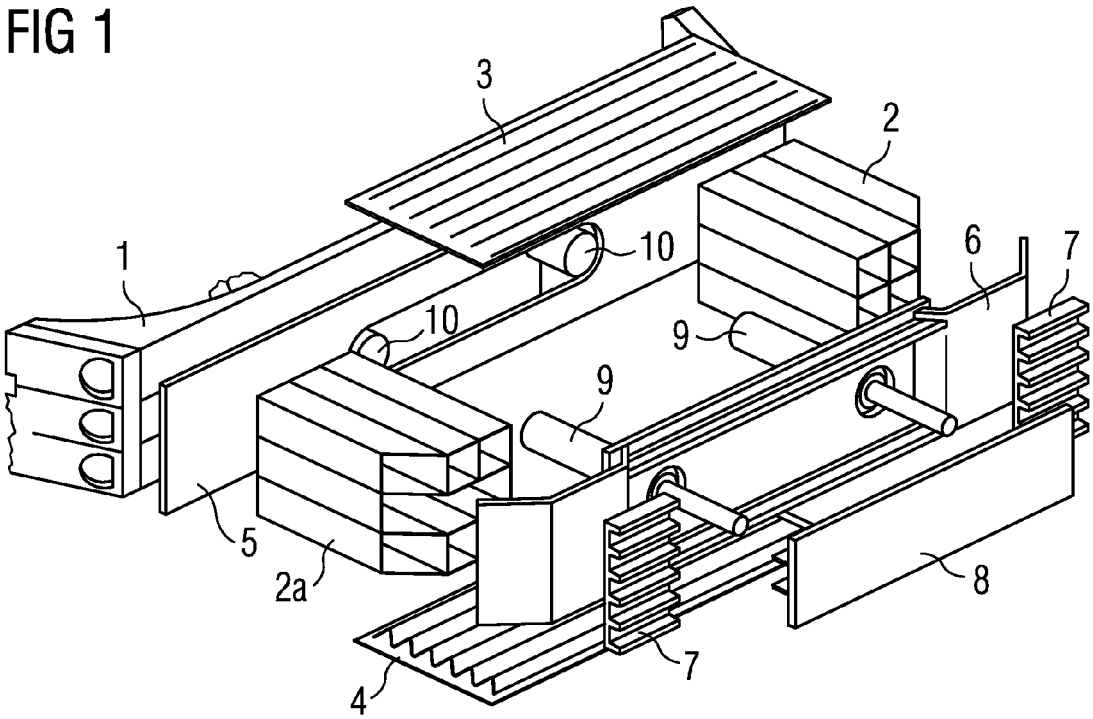
FIG. 1 shows a crash module in an exploded view

FIG. 1 shows an exemplary crash module in an exploded schematic view. In the exemplary embodiment illustrated in FIG. 1, a crash module comprises two crash elements 2, 2*a* which are arranged between a rear connecting plate 5 and a front connecting plate 6. A transverse profiled element 3 and a lower transverse profiled element 4 are in each case arranged in the area bordered by the two crash elements 2, 2*a* and the connecting plates 5, 6 and can be connected to the said components, for example by means of welded joints. In the exemplary embodiment shown, further components are depicted in the form of two buffer elements 9 which are mounted on the front connecting plate 6 and which have a bumper 8. The front connecting plate 6 is additionally provided with two toothed plates as an anti-climber structure 7. The crash module constructed in such a way is connected to the car body 1. At this connection point the car body 1 has a correspondingly stable receiving possibility to which the crash module can be secured, for instance by means of a detachable connection (e.g. screwed connection) or else by permanent fixing (e.g. by means of welding). Also provided on the car body 1 are two guide tubes 10 which serve for longitudinally guiding the buffer elements 9.

In addition to the components on which the invention is based, namely transverse profiled element 3 and lower transverse profiled element 4, the exemplary embodiment shown comprises further components which may be omitted, depending on the actual intended use of the crash module. In particular it is also provided to arrange only one transverse profiled element, in which case either the transverse profiled element 3 or the lower transverse profiled element 4 can be omitted.

Figure 2:
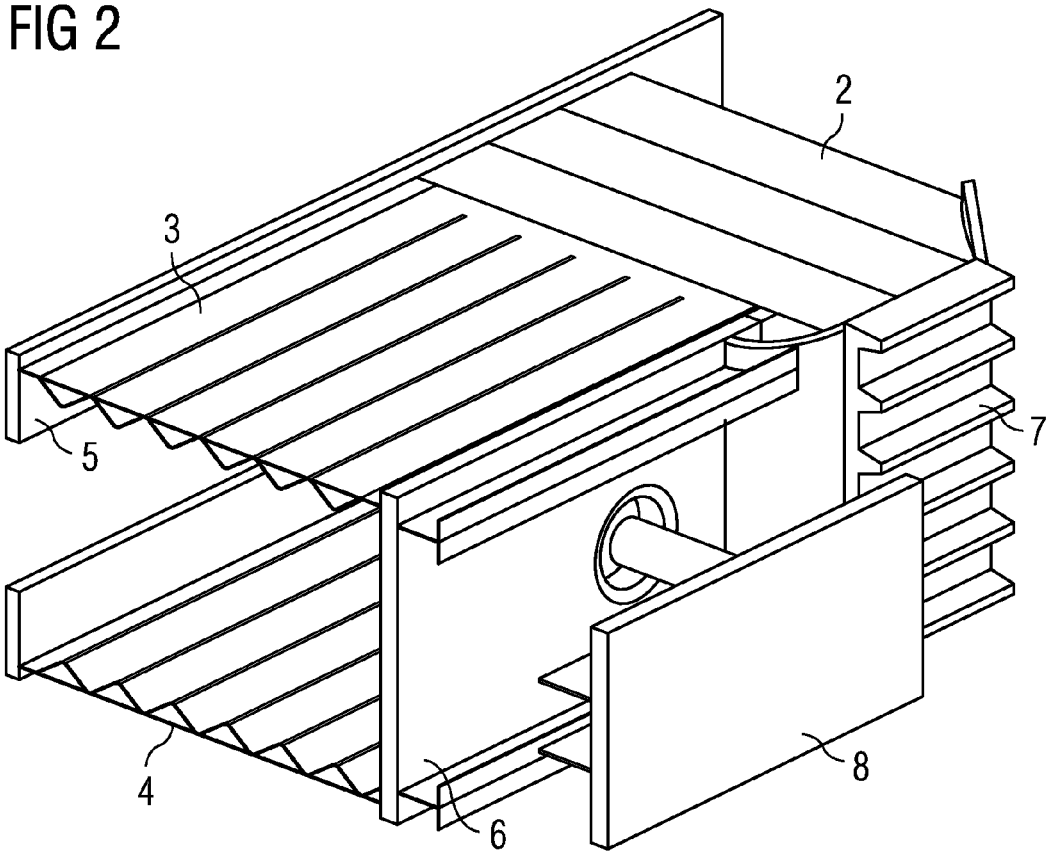
FIG. 2 shows a crash module in a sectional view, triangular profiled element

FIG. 2 shows an exemplary crash module in a schematic sectional view. A crash module sectioned in the longitudinal direction of the rail vehicle is depicted, the transverse profiled element 3 and the lower transverse profiled element 4 each being embodied as a triangular profiled element. Such a triangular profiled element has the mechanical properties required for use as a transverse profiled element (different strength in different directions).

Figure 3:
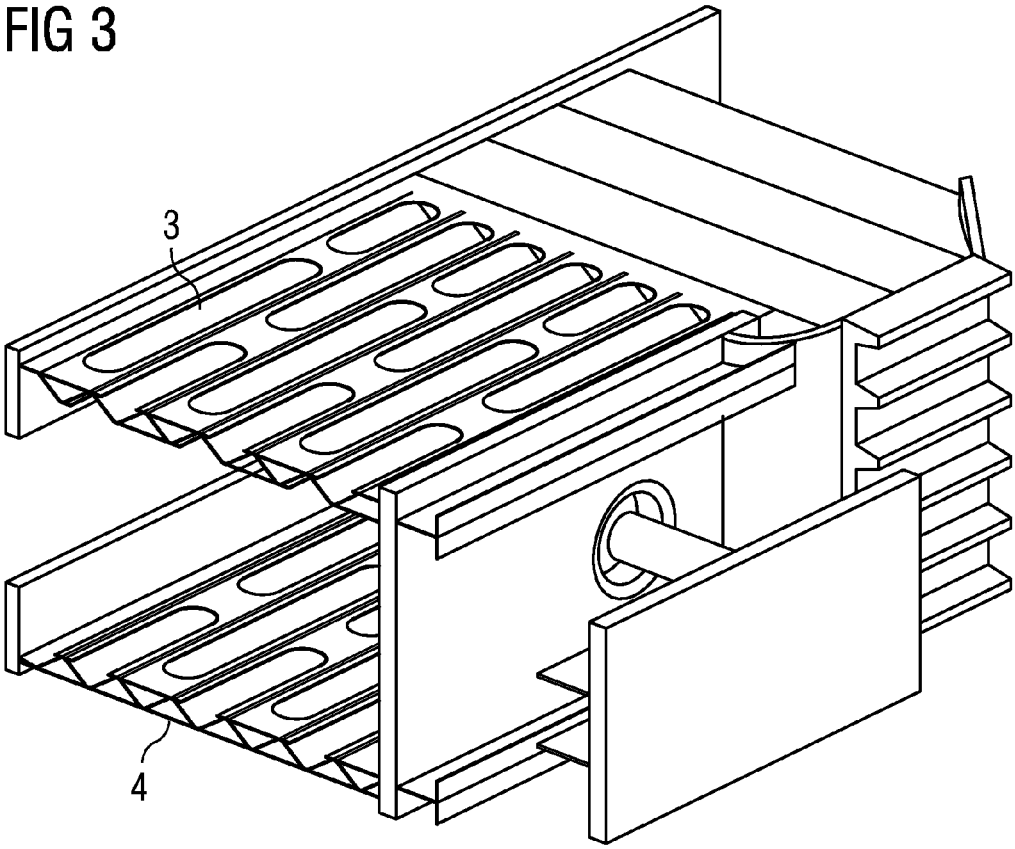
FIG. 3 shows a crash module in a sectional view, perforated profiled element

FIG. 3 shows an exemplary crash module in a schematic sectional view. A crash module sectioned in the longitudinal direction of the rail vehicle is depicted, the transverse profiled element 3 and the lower transverse profiled element 4 each being embodied as a perforated profiled element. FIG. 3 illustrates by way of example a further possible way of achieving the requisite mechanical properties of the transverse profiled elements 3, 4 by means of a substantially plate-shaped component.

Figure 4:
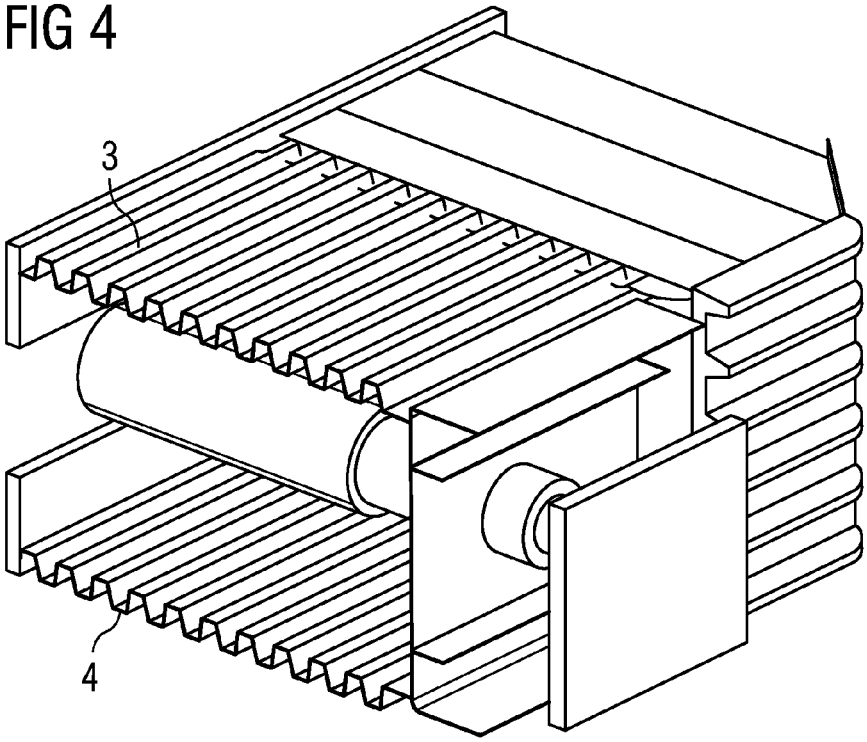
FIG. 4 shows a crash module in a sectional view, trapezoidal profiled element

FIG. 4 shows an exemplary crash module in a schematic sectional view. A crash module sectioned in the longitudinal direction of the rail vehicle is depicted, the transverse profiled element 3 and the lower transverse profiled element 4 each being embodied as a trapezoidal profiled element.

In addition to the types of embodiment shown, namely triangular profiled element, perforated profiled element and trapezoidal profiled element, all other types of embodiment are encompassed by the present invention. For example, the transverse profiled elements can achieve the requisite properties by means of rounded profiles (in the manner of corrugated sheet). Equally, all types of fabrication of the transverse profiled elements 3,4 are encompassed by the present invention; the transverse profiled elements can be obtained for instance by means of a casting or extrusion process or be constructed as multipart elements composed of discrete parts.

Figure 5:
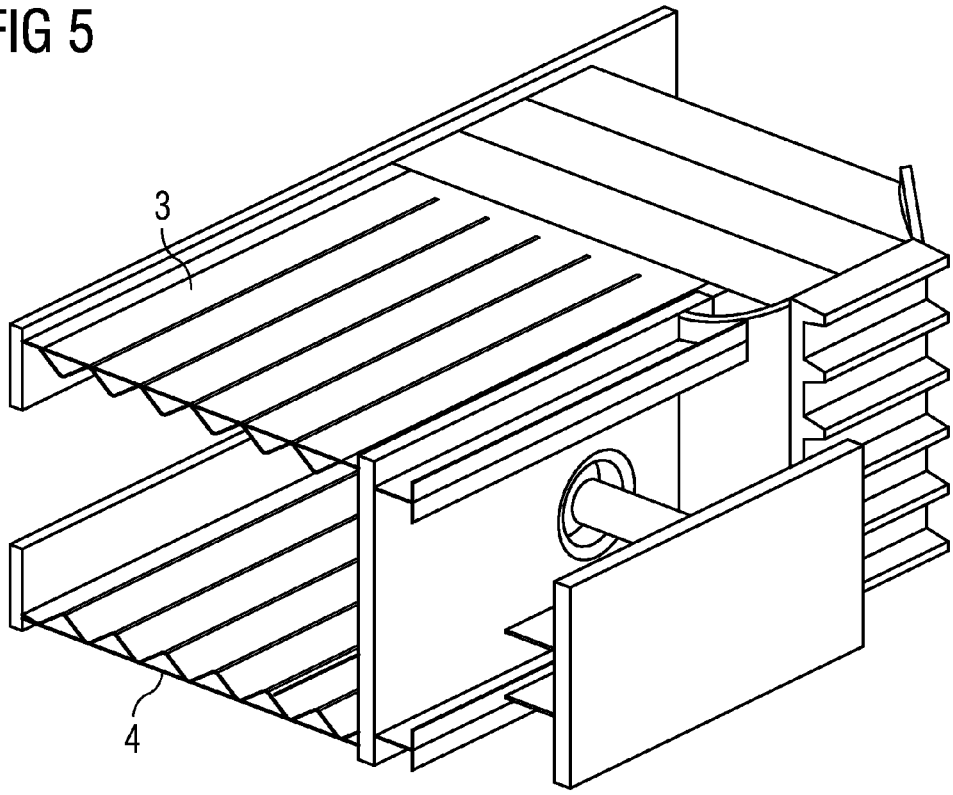
FIG. 5 shows a crash module in a sectional view, unloaded

FIG. 5 to FIG. 8: Simulation of the Deformation Behavior Under Progressively Increasing Longitudinal Load FIG. 5 shows an exemplary crash module in a schematic sectional view, in the unloaded state. The crash module from FIG. 2 is depicted, with no impact forces acting on the crash module.

Figure 6:
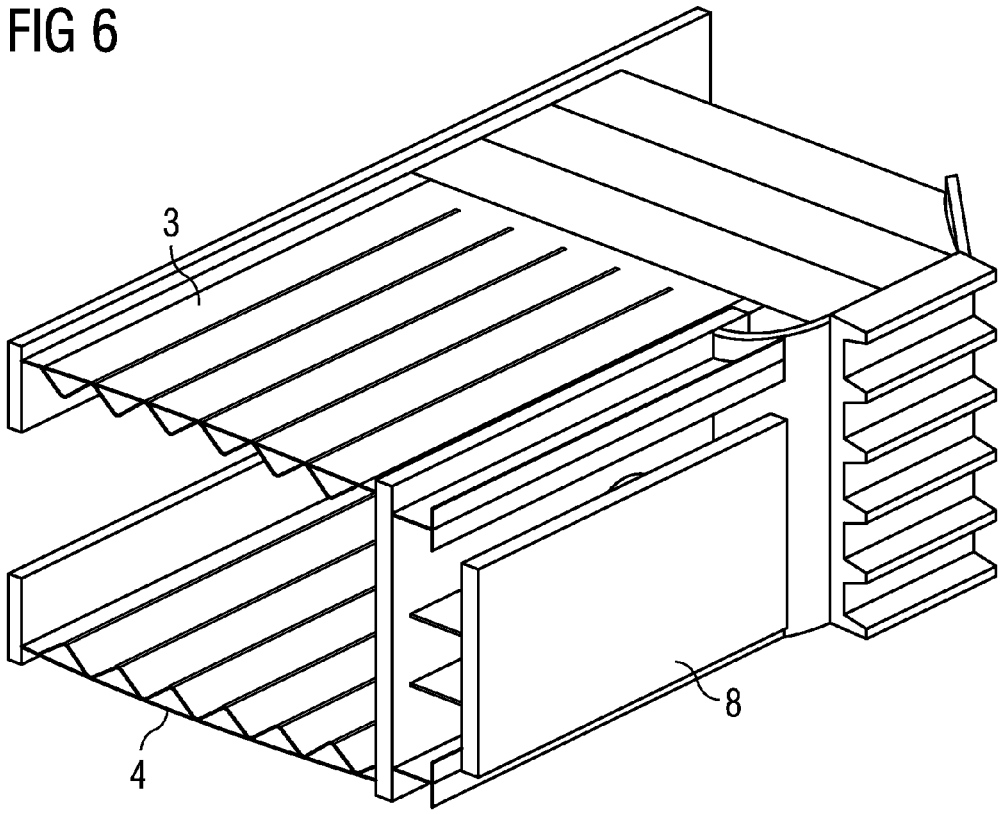
FIG. 6 shows a crash module in a sectional view, longitudinal load 1

FIG. 6 shows an exemplary crash module in a schematic sectional view, in the loaded state. The crash module from FIG. 2 is depicted, with impact forces acting on the crash module in the longitudinal direction. In this loading state the bumper 8 has already been pushed in over the maximum traveling path of the buffer elements 9 (not visible in FIG. 6). The structure of the crash module experiences no plastic deformations.

Figure 7:
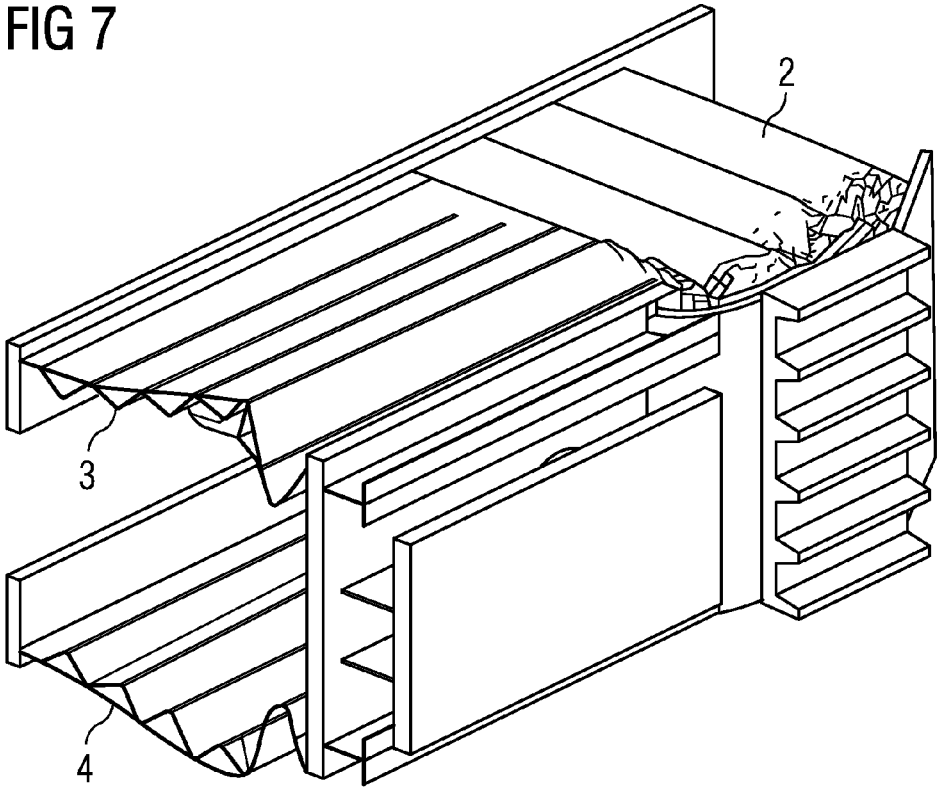
FIG. 7 shows a crash module in a sectional view, longitudinal load 2

FIG. 7 shows an exemplary crash module in a schematic sectional view, in the loaded state. The impact forces acting in the longitudinal direction are higher than in the state shown in FIG. 6. The crash element 2 exhibits plastic deformations; the transverse profiled elements 3, 4 buckle and do not impede the desired deformations of the crash elements.

Figure 8:
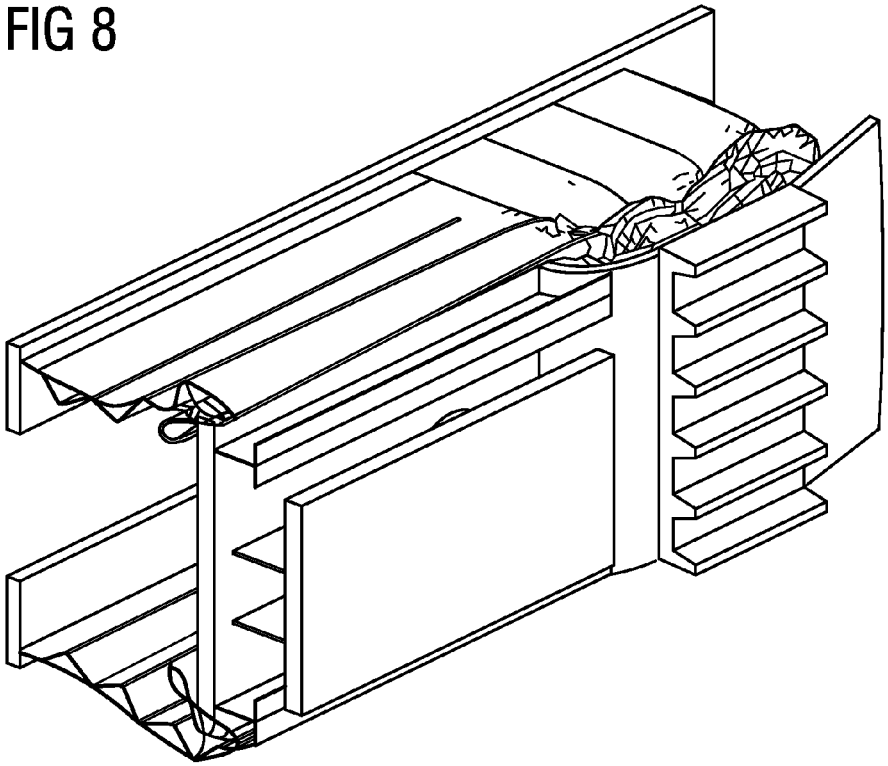
FIG. 8 shows a crash module in a sectional view, longitudinal load 3

FIG. 8 shows an exemplary crash module in a schematic sectional view, in the loaded state. The impact forces acting in the longitudinal direction are higher than in the state shown in FIG. 7. The crash element 2 exhibits massive plastic deformations; the transverse profiled elements 3, 4 are buckled to an extremely severe extent.

Figure 9:
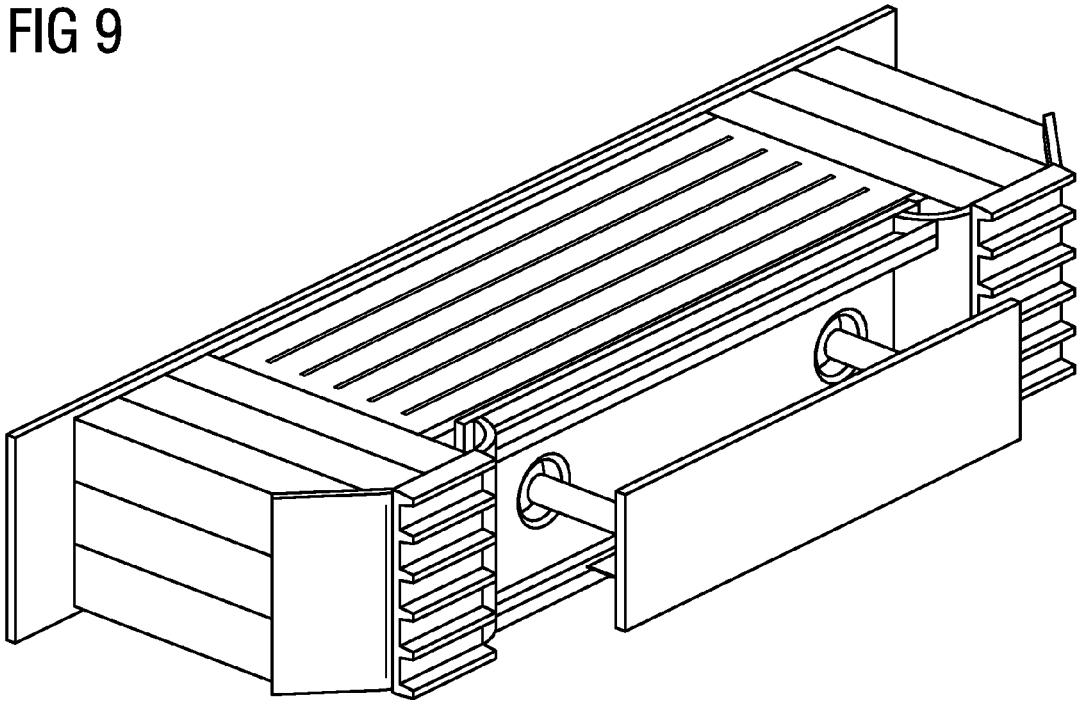
FIG. 9 shows a crash module, transverse load, unloaded
Figure 10:
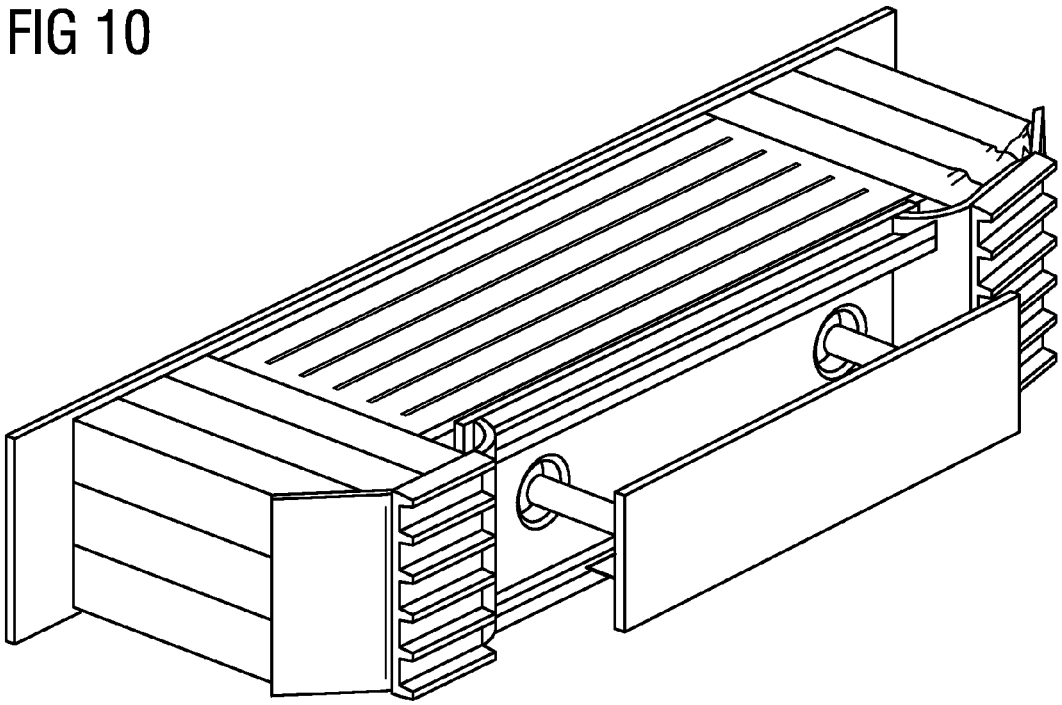
FIG. 10 shows a crash module, transverse load 1
Figure 11:
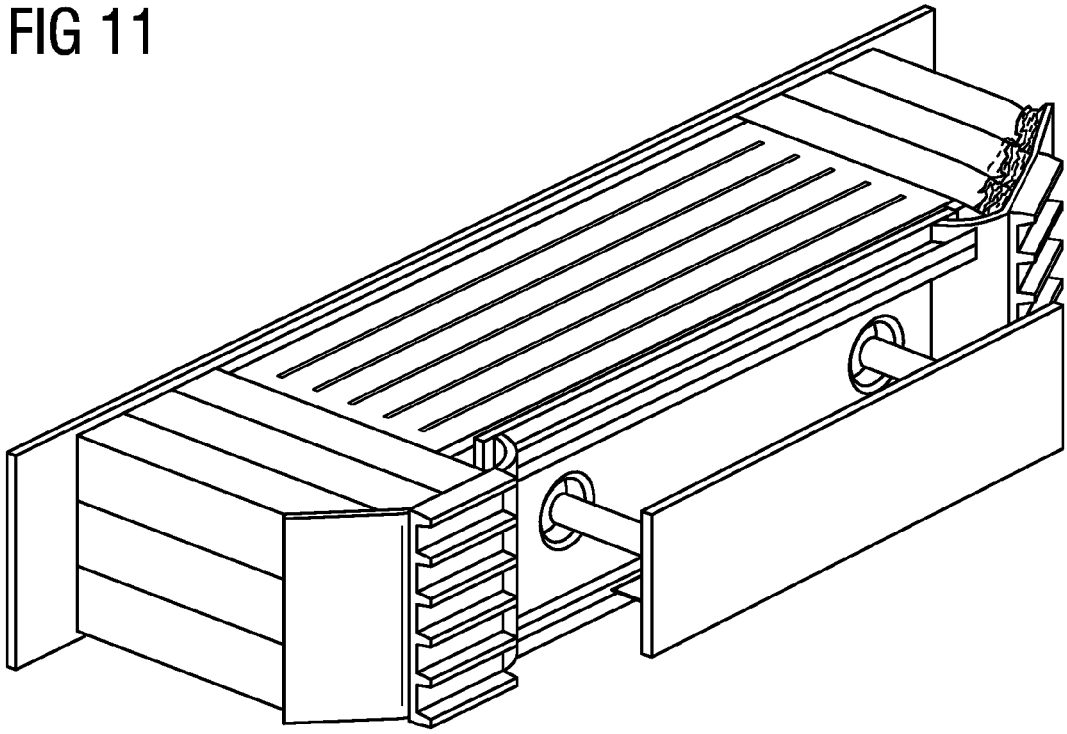
FIG. 11 shows a crash module, transverse load 2

FIG. 9 to FIG. 11: Simulation of the Deformation Behavior Under Progressively Increasing Transverse Load FIG. 9 shows a schematic view of an exemplary crash module in the unloaded state. The crash module from FIG. 1 is depicted, with no impact forces acting on the crash module.

FIG. 10 shows a schematic view of an exemplary crash module in the loaded state. The crash module from FIG. 1 is depicted, with oblique impact forces acting on the crash module. Under this load the bumper 8 and the buffer elements 9 are not pushed in because in this case the load is introduced directly in the transverse direction into the front connecting plate 6 in the region of the crash element 2. The crash element 2 has incipient plastic deformations in the region of the point at which the force is introduced.

FIG. 11 shows a schematic view of an exemplary crash module in the loaded state. The impact forces are higher than in the state shown in FIG. 10. The crash element 2 exhibits massive plastic deformations; the transverse profiled elements 3, 4 introduce the lateral force component into the solid car body structure and prevent the crash element 2 from buckling.

Figure 12:
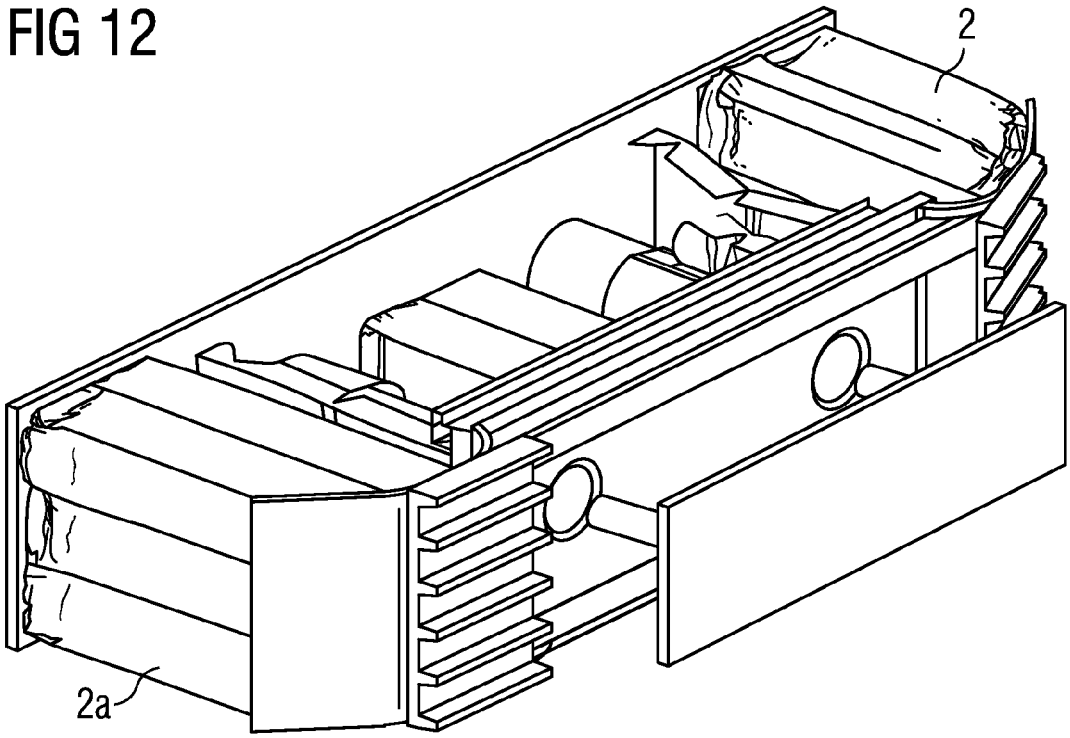
FIG. 12 shows a crash module without transverse profiled element, transverse load

FIG. 12 shows a schematic view of the simulation results of an exemplary crash module without transverse profiled element(s) after an impact applying transverse force. The crash element 2 exhibits massive plastic deformations and buckling. The lateral force component also causes incipient buckling at the crash element 2*a* and destruction of the internal components of the crash module.

LIST OF REFERENCE SIGNS

1 Car body
2, 2*a* Crash element
3 Transverse profiled element
4 Lower transverse profiled element
5 Rear connecting plate
6 Front connecting plate
7 Anti-climber
8 Bumper
9 Buffer element
10 Guide tube

The invention claimed is:

1. A crash module for a rail vehicle, comprising:

at least one crash element which is arranged in front of a vehicle structure, and at least one transverse profiled element connected to the at least one crash element, the at least one transverse profiled element having a profiled section as viewed in a longitudinal direction, such that the at least one transverse profiled element has a substantially lower compressive strength in the longitudinal direction of the rail vehicle than in the transverse direction.

2. The crash module as claimed in claim 1, wherein the transverse profiled element is a substantially plate-shaped component.

3. The crash module as claimed in claim 1, wherein the transverse profiled element has a triangular profile as viewed along the longitudinal direction of the rail vehicle.

4. The crash module as claimed in claim 1, wherein the transverse profiled element is embodied as a perforated profiled element.

5. The crash module as claimed in claim 1, wherein the transverse profiled element has a trapezoidal profile as viewed along the longitudinal direction of the rail vehicle.

6. The crash module as claimed in claim 1, wherein the at least one transverse profiled element is welded to the at least one crash element.

7. The crash module as claimed in claim 1, wherein a rear connecting plate and a front connecting plate are provided and the at least one crash element is arranged between the connecting plate and the front connecting plate.

8. The crash module as claimed in claim 7, wherein a bumper and an anti-climber are provided.

9. The crash module as claimed in claim 1, wherein comprises a detachable attachment of the crash module to a car body of a rail vehicle is provided.

10. The crash module as claimed in claim 1, wherein the crash module is embodied for establishing a permanent attachment to a car body of the rail vehicle.

11. A rail vehicle comprising a crash module as claimed in claim 1.

12. The crash module as claimed in claim 1, wherein the least one crash element includes at least two crash elements laterally arranged at either side of a longitudinal axis of the rail vehicle, and wherein the at least one transverse profiled element is secured above and/or below the laterally arranged crash elements.

13. A crash module for a rail vehicle, comprising:

at least one crash element which is laterally arranged in front of a vehicle structure, and at least one transverse element connected to the at least one crash element, the at least one transverse element having a triangular or trapezoidal profiled section along a longitudinal direction of the rail vehicle, and is arranged with respect to the at least one crash element such that an energy absorbing effect of the at least one crash element is substantially unchanged for an impact in the longitudinal direction, while for a transverse impact, the at least one transverse element supports the at least one crash element such and transfers a lateral force component to the vehicle structure.

* * * * *